US005370454A

United States Patent [19]

Domenig

[11] Patent Number: 5,370,454

[45] Date of Patent: * Dec. 6, 1994

[54] DRAWER WITH TRIM SHAPE

[75] Inventor: Georg Domenig, Kernersville, N.C.

[73] Assignee: Grass AG, Hochst/Vlbg., Austria

[ * ] Notice: The portion of the term of this patent subsequent to Mar. 30, 2010 has been disclaimed.

[21] Appl. No.: 3,478

[22] Filed: Jan. 12, 1993

Related U.S. Application Data

[63] Continuation of Ser. No. 665,012, Mar. 5, 1991, Pat. No. 5,197,791.

[30] Foreign Application Priority Data

Mar. 19, 1990 [DE] Germany ..... 4007850
May 22, 1990 [DE] Germany ..... 4016452

[51] Int. Cl.[5] ..... A47B 88/00

[52] U.S. Cl. ..... 312/348.1; 312/184; 403/363

[58] Field of Search ..... 312/348.1, 348.5, 348.2, 312/330.1, 183, 184, 270.3; 403/380, 363

[56] References Cited

U.S. PATENT DOCUMENTS

| | | | |
|---|---|---|---|
| 3,462,208 | 8/1969 | Black et al. | 312/330.1 X |
| 3,647,101 | 3/1972 | Hensch et al. | 312/184 X |
| 4,102,470 | 7/1978 | Timmons | 312/183 X |
| 4,173,378 | 11/1979 | Hanson et al. | 312/270.3 X |
| 4,234,238 | 11/1980 | Figueroa | 312/184 |
| 4,786,123 | 11/1988 | Rock et al. | 312/341.1 |
| 5,197,791 | 3/1993 | Domenig | 312/348.1 |

*Primary Examiner*—Stephen C. Pellegrino
*Assistant Examiner*—Nancy Mulcare

[57] ABSTRACT

A description is given of a drawer with a trim shape, the drawer moving on guide rollers over guide rails, and the drawer having front and rear sides along with drawer sides opposite each other.

In order to protect the drawer sides from internal or external effect, and to give the drawer additional stability, the trim shape is designed as an elongated shaped component mounted on the sides of the drawer, a shoulder being arranged at the top side of a drawer side for locking the shaped component, the bottom side of the shaped component engaging a locking groove of the drawer side.

9 Claims, 8 Drawing Sheets

DRAWER WITH TRIM SHAPE

This application is a continuation application of my copending application Ser. No. 07/665,012 filed Mar. 5, 1991, now U.S. Pat. No. 5,197,791.

FIELD AND BACKGROUND OF THE INVENTION

The invention relates to a drawer with trim shape, the drawer moving on guide rollers in guide rails, and the drawer having a front side and a rear side as well as drawer sides opposite each other.

This kind of drawer is known in the construction of kitchen furniture where it is desired to give the drawers an aesthetically pleasing trim and to protect the outsides of the drawer from the penetration of moisture, dust or the like.

Kitchen furniture is also known in particular to have drawers with perforations in the side walls, the side walls forming upper and lower boundaries with a gap running between these boundaries. One of the drawbacks of this kind of drawer is that dust or moisture can penetrate through the gaps in the drawer side walls or the contents can come out through the gap in the drawer side walls.

SUMMARY OF THE INVENTION

The object of the present invention is thus to develop a drawer of the type mentioned so that drawer side walls can also be protected and stiffened while having an aesthetically pleasing design.

This object is achieved by the invention in that the trim shape is designed as an elongated shaped component mounted on the drawer sides, a shoulder on which the shaped component locks being arranged at the top side of a drawer side, and the bottom side of the shaped component engaging a locking groove of the drawer side.

Accordingly, the essential feature of the invention is that a shaped component locks or is slid onto the sides of a drawer and that locking or mounting components running longitudinally are provided on both the top side and the bottom side of the side walls of a drawer, the shaped component locking or being slid onto them with a suitable engaging or locking means.

This object is also achieved in that, just as with the first solution, the trim shape is designed as an elongated shaped component mounted on the drawer sides, which now has a shoulder in a longitudinal arrangement on which the shaped component locks, the bottom side of the shaped component engaging a locking groove at the bottom side of the drawer side.

The essential feature of this solution is now that the locking shoulder is not arranged at the top side of the drawer side but rather at the side of the drawer side, that is, the locking feature and the side covering of the drawer frame are now no longer in the upper area of the drawer side wall but rather at the side of the drawer side wall. This solution is suitable for the side covering of a drawer frame, particularly in the case of shallow drawers, In connection with the shaped component arranged at the side wall of a drawer, the side wall of the drawer itself is now protected and, furthermore, the locked shaped component increases the stability of the drawer itself. An additional effect is the advantage that the drawer side has an aesthetically pleasing appearance when it is drawn out.

In line with the essential idea of the invention, the locking of the shaped component on the drawer side can be designed differently, one advantageous development having the shoulder extending straight upward, the shaped component overlapping the shoulder with an accurately fitting overlap.

In a further embodiment, the shoulder forms a locking groove bent inward, which is engaged by the shaped component with a rib.

There are also several designs for locking the bottom side of the shaped component on the drawer side. In one advantageous design, the locking groove on the drawer side is formed by an overlap, one bent down catch of the shaped component engaging the locking groove.

In another embodiment, the locking groove is formed in a hollow shape in the drawer side wall, a bent edge of the shaped component engaging the locking groove with an upward bent projection.

In another embodiment, the shaped component is designed so that additional devices can be mounted on the shaped component itself, a bent down shoulder running longitudinally preferably being arranged above the overlap and having a groove directed toward the drawer.

In yet another embodiment, a longitudinally running stem projecting upward is arranged as a functional shape above the shoulder of the shaped component.

It is advantageous, furthermore, for the shaped component to have a channel directed inwardly opposite a channel of the drawer side wall, which forms a bearing surface for a filler arranged in the shaped component.

The shaped component can be additionally stiffened by the introduction of the filler, and, in conjunction with the locking of the shaped component on the drawer side wall, the drawer will also have increased stability.

In another embodiment, provision can be made for the drawer side wall in the area of the overlap to be designated as a hollow shade through the shaped components.

Other advantageous developments of the shaped components will be seen in the secondary claims.

The invention will now be explained in more detail using example embodiments with the description following indicating further advantages and features of the invention.

DETAILED DESCRIPTION OF THE DISCLOSURE

Figure 1:
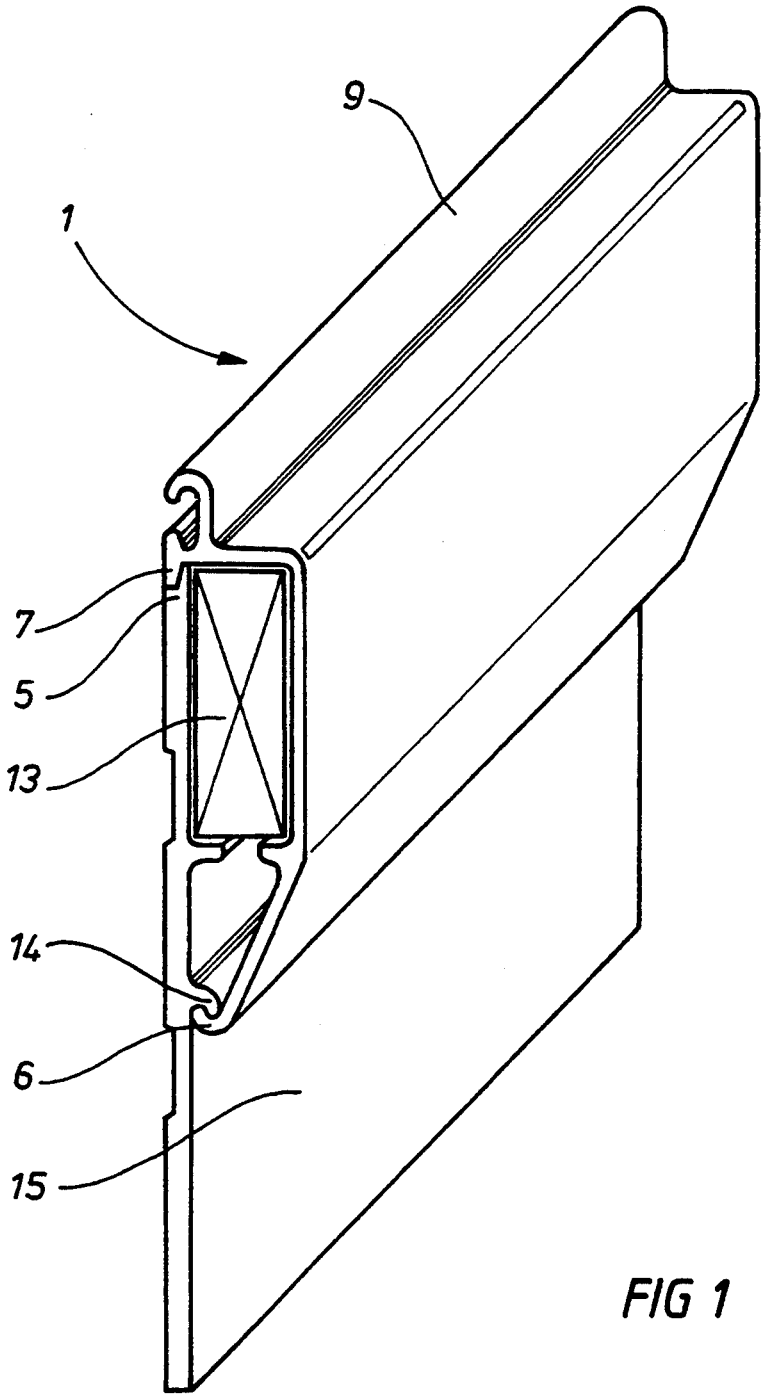
FIG. 1 is a perspective view of the invented shaped component in its arrangement on the drawer side wall.
Figure 2:
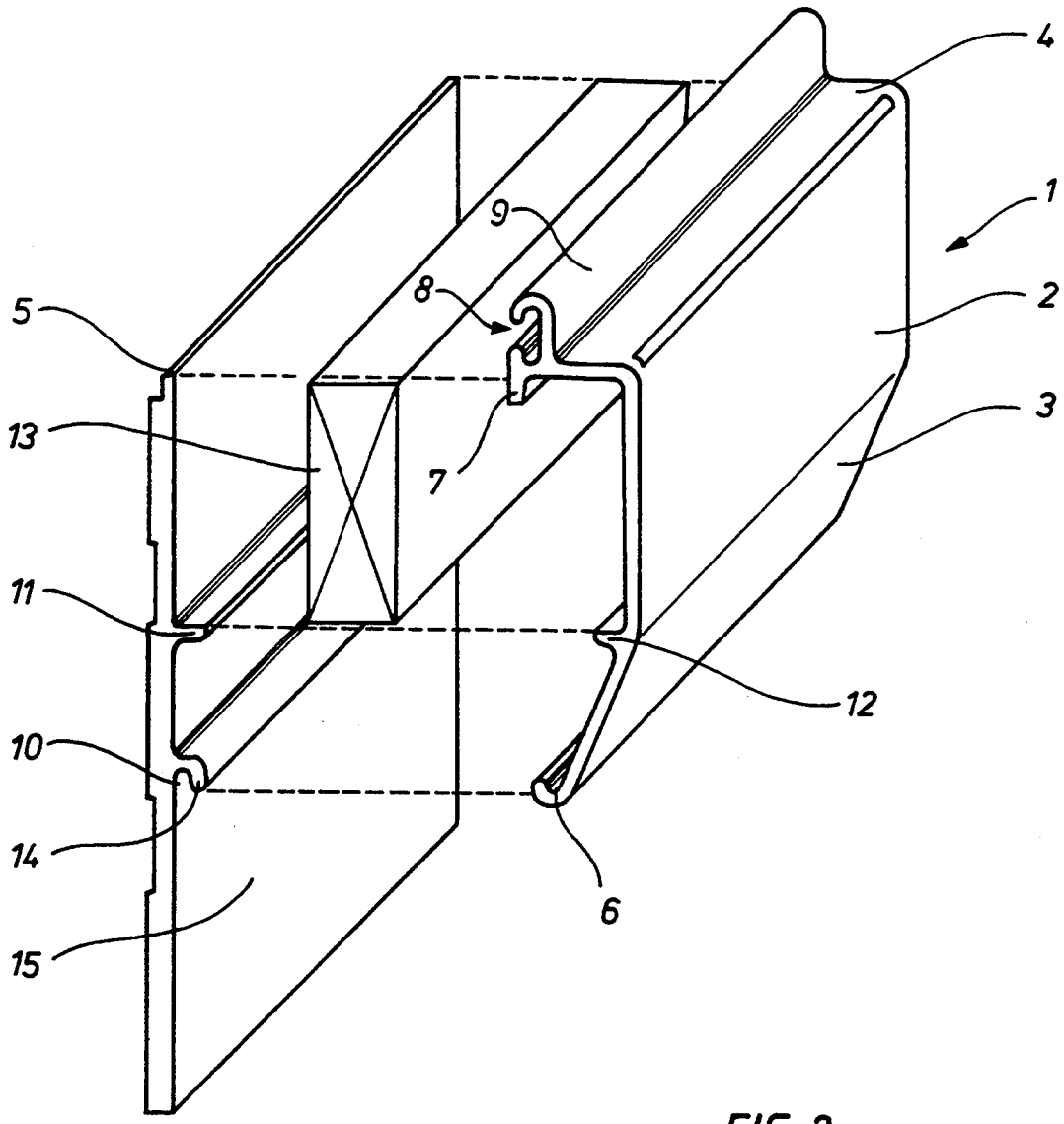
FIG. 2 is the invented shaped component in perspective and detached from the drawer side wall.

FIGS. 1 and 2 show the shaped component 1 in the assembled condition and separated from the drawer side wall. It can be seen that the shaped component 1 consists of a wall 2 running longitudinally with a bent down bottom leg 3 along with a bent up top leg 4.

FIGS. 1 and 2 also show the special locking arrangement of the shaped component 1 on the drawer side wall 15, the overlap 7 of the shaped component 1 overlapping a shoulder 5 of the drawer side wall, and the catch 6 at the bottom side of the shaped component 1 engaging a locking groove 10 on the drawer side wall, the locking groove being formed by an overlap 10.

A rounded off shoulder 9 extends upward at the top side of the shaped component 1 and has a groove 8 directed inwardly into which additional devices of the drawer can be inserted.

The shaped component also has a rib 12 in the area of its longitudinal extension close to the bottom side and opposite a rib 11 of the drawer side wall so as to form a bearing surface, and a filler 13 can be inserted into the cavity made between the bearing surface and the top side of the shaped component.

Figure 3:
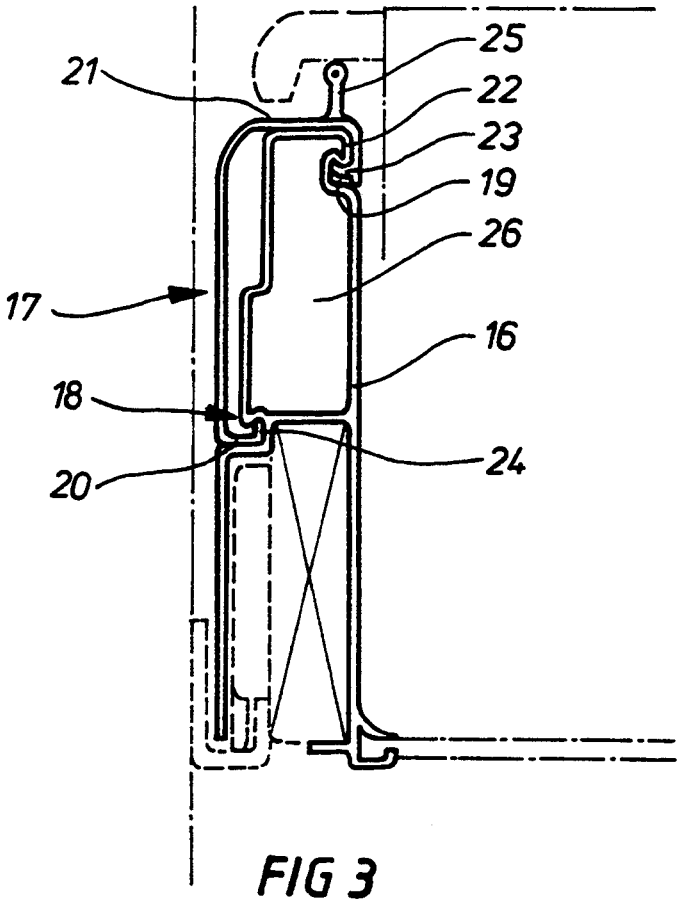
FIG. 3 is a cross-section of an invented shaped component in another embodiment mounted on the drawer side wall.

FIG. 3 shows a shaped component 17 in another embodiment, the drawer side in conjunction with a hollow shape 26 forming a locking groove 18 at about the middle area, this groove being engaged by a leg 20 of the shaped component 17 with an upward bent projection 24.

The frame shape 16 is designated as a hollow shape 26, a bent down shoulder 22 being provided at the top side of the drawer side wall for locking the shaped component 17, this shoulder being arched inward to form a locking groove 19. The locking groove 19 is engaged by a leg 21 of the shaped component 17 with a leg directed downward, the locking groove being engaged in particular by a rib 23.

A stem is arranged longitudinally at the top side of the shaped component as a functional shape to which additional devices of the drawer can be fastened.

Figure 4:
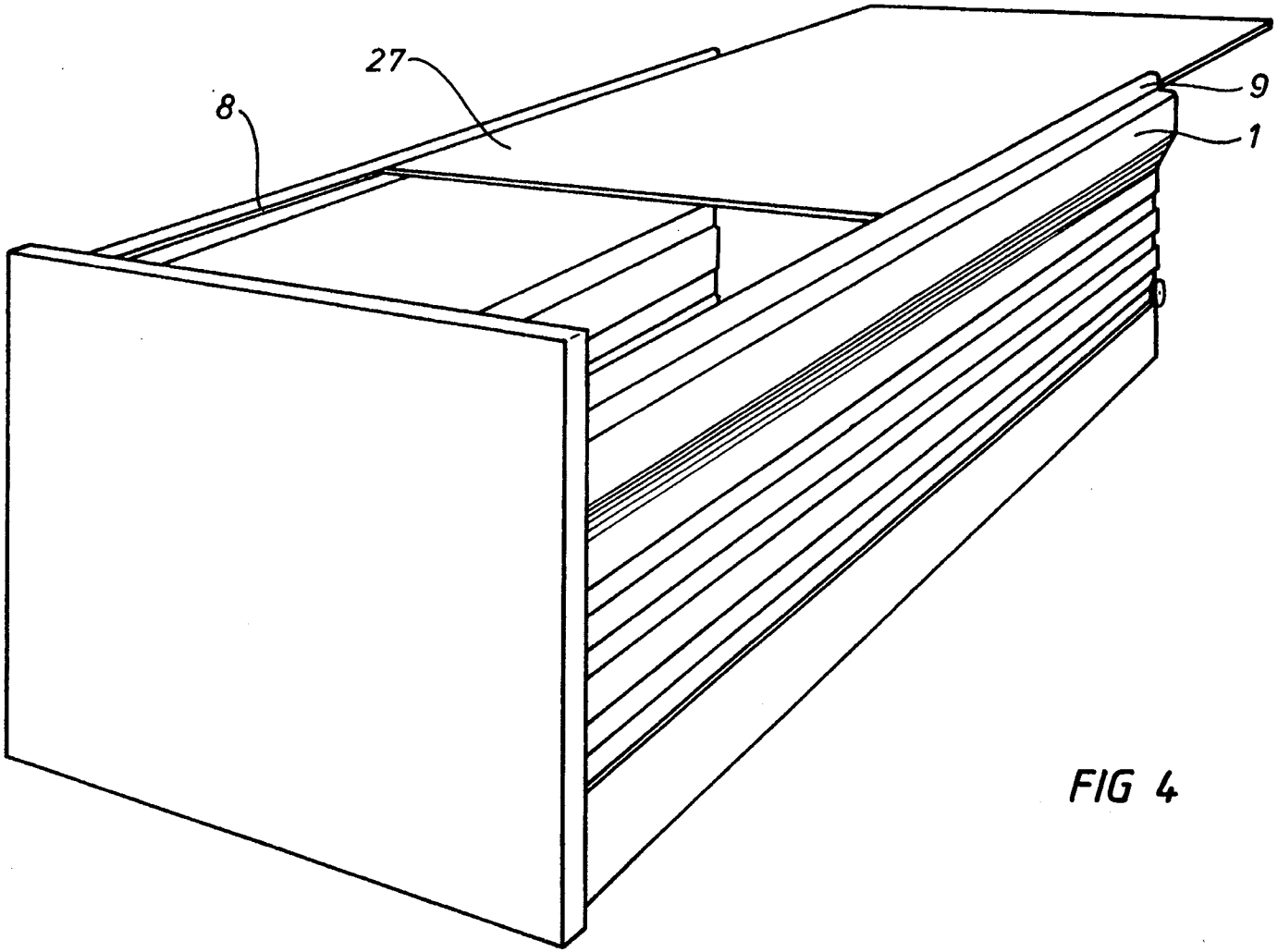
FIG. 4 is a drawer with a mounted shaped component with hanging file arrangement on the shaped component.

FIG. 4 is a perspective view of the drawer and shows that a cover 27 is inserted into the groove 8 of the shaped component 1 of FIG. 2 to achieve a protective covering of the interior of the drawer.

Figure 5:
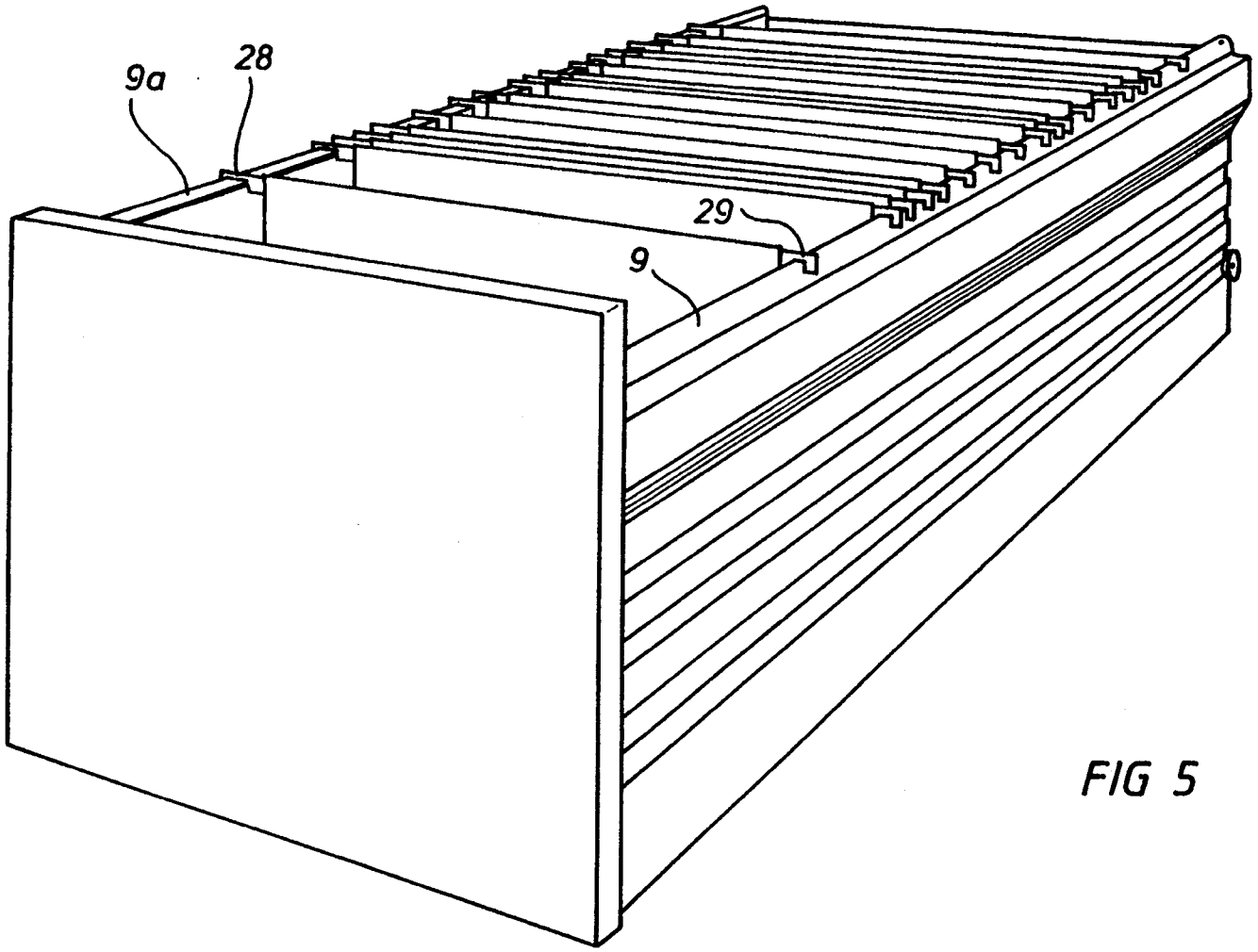
FIG. 5 is a drawer with mounted shaped component with cover plate arranged on the shaped component.

FIG. 5 is an illustration of a further embodiment of a shaped component 1 according to FIG. 2 and shows that the shaped component upwardly has a rounded off shoulder 9 and a flat shoulder 9*a*. Differently shaped stems of a hanging file are laid on this shoulder 9, 9*a*. With this special design of the shaped component 1, 17 toward the top side, different shapings can be provided for mounting additional devices of the drawer on the shaped component.

Figure 6:
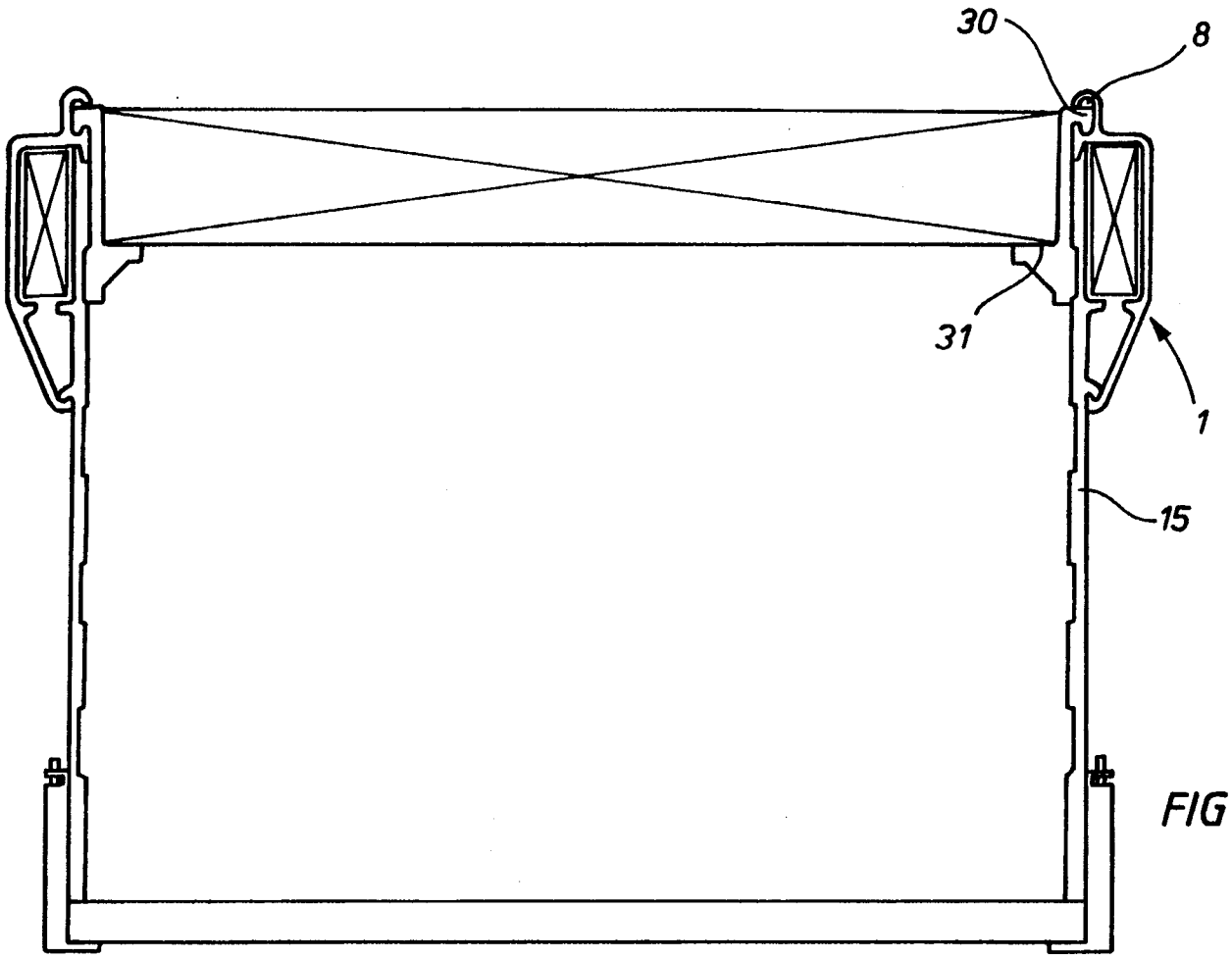
FIG. 6 is a drawer with the shaped component in cross-section, additional suspension legs being provided for arrangement of a file box.

FIG. 6 illustrates the shaped component according to FIGS. 1 and 2, a suspension leg 30 being suspended in the groove 8, this leg pointing inwardly toward the drawer with a bearing surface 31 on which a file, sorting bos or the like can be laid.

The suspension leg 30 has an interrupted arrangement in the longitudinal direction of the drawer, but can also be arranged in sections. Similarly, the shoulder 9, 9*a* or the stem 25 can be continuous along the longitudinal side of a drawer side, or this special shaping can be provided in sections only, which achieves additional advantages. In conjunction with the sectional arrangement of the shoulder 9, 9*a* and/or the stem 25, catches can be provided, and drawer devices can be mounted in a neat arrangement depending on the subdivisions on the shaped components 1, 17.

Figure 7:
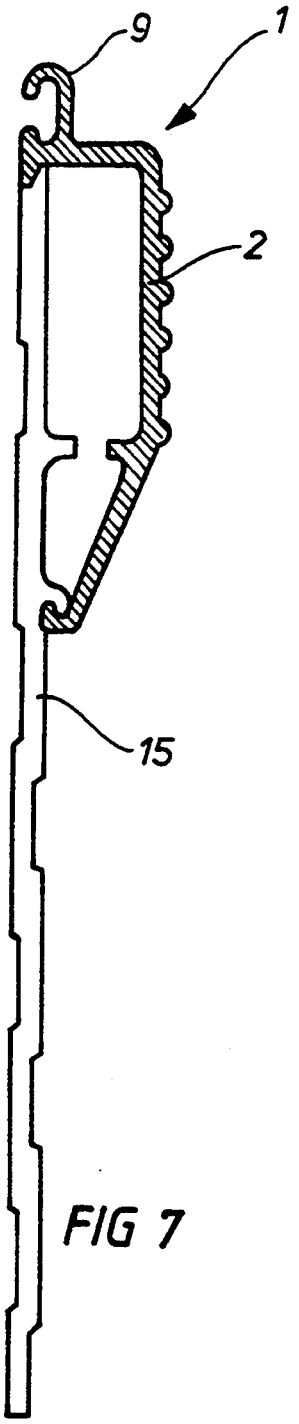
FIG. 7 is the shaped component in cross-section with an additional side shaping of the shaped component.

FIG. 7 shows a further development of the shaped component 1 where the shaped component 1 has wave-like elevations in cross-section at the side wall 2, so that strip-like shapings are provided, particularly as seen in the longitudinal direction, which deflect dust, moisture or the like and also give the side wall an aesthetic appearance.

FIGS. 8 to 11 illustrate a further solution for locking a shaped component on a drawer side wall, the shaped component 32 now being mounted from the side on the drawer side wall.

Figure 8:
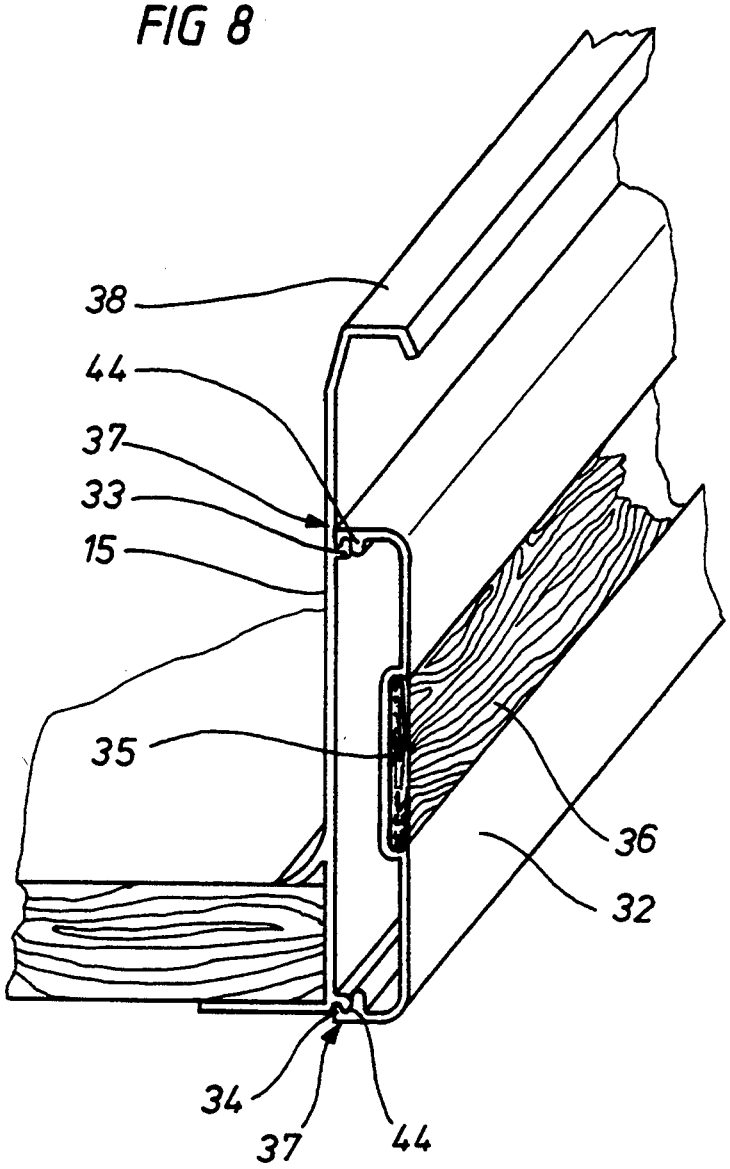
FIG. 8 is a drawer side wall with side locking of the shaped component according to a further embodiment.

FIG. 8 shows that the trim shape 32 can be inserted or locked on in the same way as described in FIGS. 1 and 2, it being important here that the locking-on and the side covering of the drawer frame now no longer be carried out in the upper area of the drawer side wall but rather, particularly in accordance with FIG. 8, that the locking-on be carried out directly at the side of the drawer frame. In this case, the trim component or the trim shape 32 is particularly suitable for shallow drawers.

FIG. 8 shows that a locking groove 35 is provided in the trim rail 32 itself for locking, inserting, clamping or cementing a further trim component.

This additional trim shape 36 can have any kind of design. For example, it can bear the logo of the kitchen furniture manufacturer; it can be made of wood, plastic or any other material; it can have surfaces that are punched, ribbed, grooved, etc., depending on the kind of trim desired.

Figure 11:
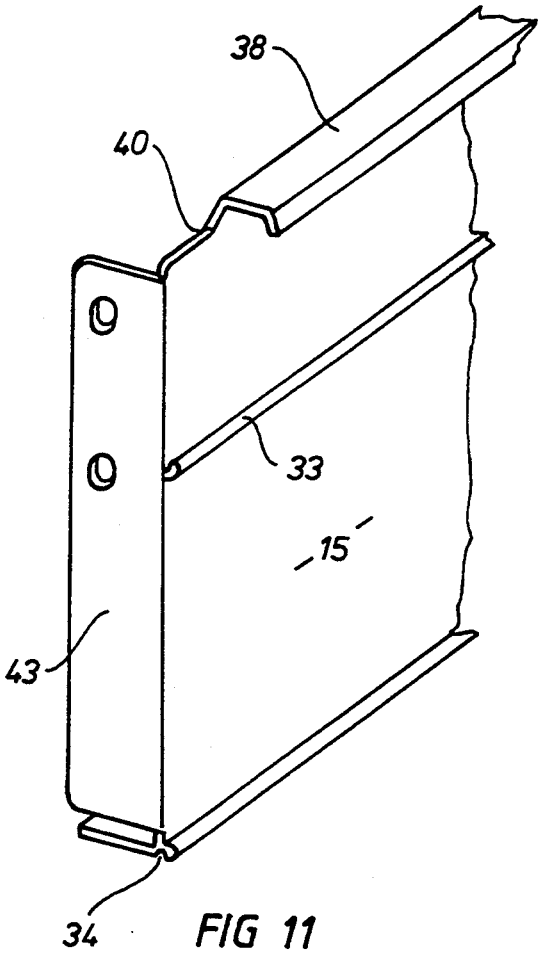
FIG. 11 is the outside of the drawer side wall in FIG. 8 with the side locking shoulder and bottom locking groove.
Figure 9:
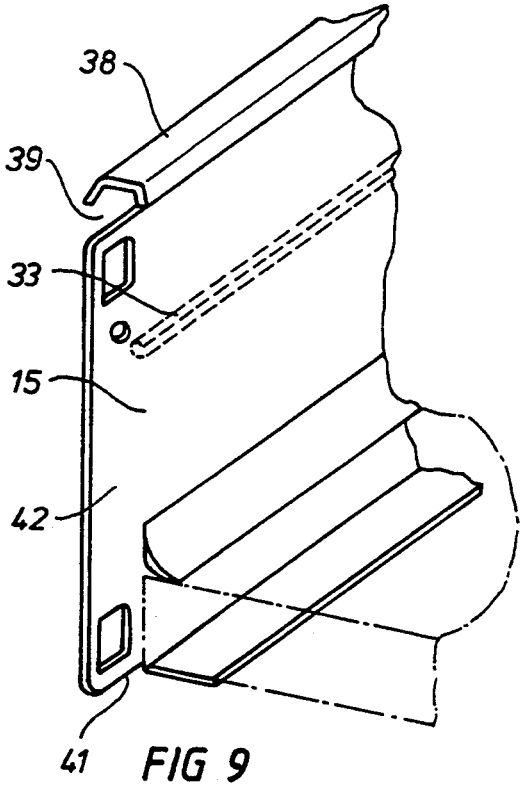
FIG. 9 is an interior view of a drawer side wall with front mounting angle not yet bent down.
Figure 10:
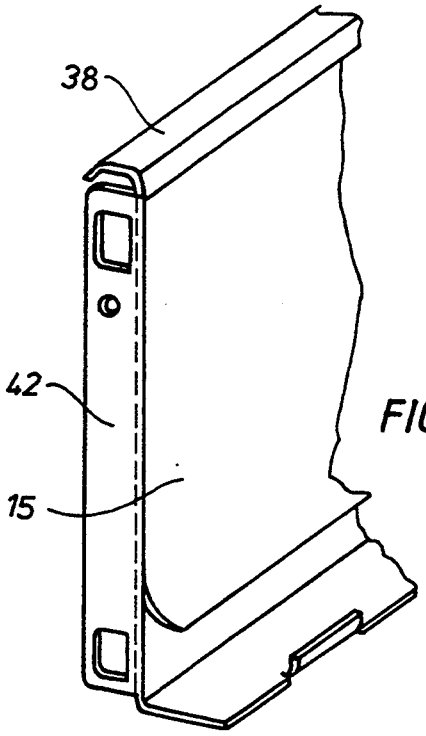
FIG. 10 is an interior view of a drawer side wall with front mounting angle bent down.

FIGS. 9 and 10 show the inner side of the drawer side wall, the locking shoulder 33 and the inserted drawer base. FIGS. 9 to 11 show the front mounting flanges 42 that are not yet bent in FIG. 9. FIG. 8 shows only a section through the drawer and does not show the mounting flanges 42 at the front for mounting the front panel.

It is important with respect to FIGS. 9 to 11 that the entire drawer side wall be made of an extruded plastic material, which can be manufactured at low cost. As FIGS. 9 and 10 show, the drawer base is locked in place in that a flange is bent up on the bottom, foot-side part of the drawer side wall 15 and engages a slot (not shown) in the drawer base, while the drawer base is secured at the top from lifting upward by a flexible rib projecting inward from the side. When the side wall 15 is made of plastic, sheet metal or aluminum, the mounting flange 42 not yet bent in FIG. 9 will preferably first be straight and then bent in accordance with FIG. 10. The same mounting also applies in other respects for the rear wall, the rear wall being provided with a mounting flange 42 of the same kind.

Mounting of the shaped component 32 is carried out at the drawer side wall by locking, snapping in, inserting, cementing or clamping.

It is also important according to FIGS. 9 to 11 that stampings 39, 40 be made in the forward and rear areas of the sliding surface 38 as well as a stamping 41 in the bottom area of the side wall. This makes it possible to bend in the mounting flange 42 in the area of the upper and lower sliding surfaces, as is shown in FIG. 10.

As FIG. 8 shows, the side arrangement of the shaped component 32 on the side wall 15 is suitable particularly for shallow drawers, the shaped component 32 being locked, inserted or mounted otherwise in a simple way on the locking shoulder 33 and on the locking groove 34 at the bottom side of the side wall. The shaped component 32 has catches 37 in this mounting area (FIG. 8), which overlap the locking shoulder 33 and lock into the locking groove 34. Following the catch 37, the shaped component has a further shoulder 44, which fits at the outside on the locking components of the drawer side wall 15 and provides additional security in conjunction with the catch 37.

What is claimed is:

1. In a drawer moving on guide rollers in guide rails, the drawer having a front side, a rear side and opposing drawer sides, and the opposing drawer sides having latching elements positioned thereon, the improvement comprising a trim shape having shoulders operable with the latching elements of the opposing drawer sides to releasably secure the trim shape to the drawer side.

2. The improvement as claimed in claim 1 wherein the latching elements include locking shoulders and locking grooves.

3. The improvement as claimed in claim 1 wherein the locking members include latching element engaging shoulders and trim shape is elongated.

4. The improvement as claimed in claim 1 further comprising mounting flanges formed in the drawer sides and engaging the front and rear sides.

5. The improvement as claimed in claim 1 further comprising a further locking groove in the trim shape, and a further trim component positioned within the further locking groove.

6. The improvement as claimed in claim 3 wherein the locking members include latching element engaging shoulders and locking grooves.

7. The improvement as claimed in claim 5 wherein the trim shape is elongated.

8. The improvement as claimed in claim 7 further comprising mounting flanges formed in the opposing drawer sides and engaging the front and rear sides.

9. The improvement as claimed in claim 2 further comprising a further locking groove in the trim shape, and a further trim component positioned within the further locking groove.

* * * * *